US009108297B2

(12) United States Patent
Schubert et al.

(10) Patent No.: US 9,108,297 B2
(45) Date of Patent: Aug. 18, 2015

(54) SYSTEMS FOR ABRASIVE JET PIERCING AND ASSOCIATED METHODS

(75) Inventors: Ernst H. Schubert, Snoqualmie Pass, WA (US); Peter H.-T. Liu, Bellevue, WA (US); Axel H. Henning, Black Diamond, WA (US); David B. McNiel, Staten Island, NY (US)

(73) Assignee: OMAX Corporation, Kent, WA (US)

( * ) Notice: Subject to any disclaimer, the term of this patent is extended or adjusted under 35 U.S.C. 154(b) by 347 days.

(21) Appl. No.: 13/165,009

(22) Filed: Jun. 21, 2011

(65) Prior Publication Data

US 2012/0021676 A1 Jan. 26, 2012

Related U.S. Application Data

(60) Provisional application No. 61/357,068, filed on Jun. 21, 2010.

(51) Int. Cl.

| | |
|---|---|
| ***B24C 1/00*** | (2006.01) |
| ***B24C 3/00*** | (2006.01) |
| ***B24C 1/04*** | (2006.01) |
| ***B24C 5/02*** | (2006.01) |
| ***B24C 7/00*** | (2006.01) |

(52) U.S. Cl.

CPC . *B24C 1/045* (2013.01); *B24C 5/02* (2013.01); *B24C 7/0084* (2013.01)

(58) Field of Classification Search

CPC ..... B24C 1/045; B24C 5/02; B24C 7/0084
USPC ..... 451/2, 36, 38, 40, 99, 101, 102; 83/53, 83/177

See application file for complete search history.

(56) References Cited

U.S. PATENT DOCUMENTS

| | | | |
|---|---|---|---|
| 773,665 | A | 11/1904 | Murray |
| 2,929,120 | A | 3/1960 | Brandt et al. |
| 2,985,050 | A | 5/1961 | Schwacha |

(Continued)

FOREIGN PATENT DOCUMENTS

| | | | |
|---|---|---|---|
| CN | 101811287 | A | 8/2010 |
| EP | 0165690 | A2 | 12/1985 |

(Continued)

OTHER PUBLICATIONS

Fox Solids Conveyying Eductors, http://www.flowmeterdirectory.com/solid_conveying_eductor.html, accessed May 24, 2011, 2 pages.

(Continued)

*Primary Examiner* — Joseph J Hail
*Assistant Examiner* — Marc Carlson
(74) *Attorney, Agent, or Firm* — Perkins Coie LLP

(57) ABSTRACT

Various embodiments of abrasive jet cutting systems are disclosed herein. In one embodiment, an abrasive jet system includes a cutting head configured to receive abrasives and pressurized fluid to form an abrasive jet. The system also includes an abrasive source configured to store abrasives that are supplied to the cutting head, as well as a fluid source configured to store fluid that is supplied to the cutting head. The system further includes a gas source configured to store pressurized gas that is selectively supplied to the cutting head. When supplied to the cutting head, the pressurized gas can advantageously affect, such as by at least partially diffusing, the abrasive jet.

19 Claims, 8 Drawing Sheets

(56) References Cited

U.S. PATENT DOCUMENTS

| | | | | | |
|---|---|---|---|---|---|
| 3,270,464 | A | | 9/1966 | Bowling, Jr. et al. | |
| 3,543,444 | A | * | 12/1970 | Mehta | 451/2 |
| 3,769,753 | A | | 11/1973 | Fleischer | |
| 4,075,789 | A | | 2/1978 | Dremann | |
| 4,125,969 | A | | 11/1978 | Easton | |
| 4,253,610 | A | | 3/1981 | Larkin | |
| 4,478,368 | A | * | 10/1984 | Yie | 239/430 |
| 4,666,083 | A | | 5/1987 | Yie | |
| 4,785,027 | A | * | 11/1988 | Brasington et al. | 521/157 |
| 4,802,312 | A | | 2/1989 | Glaeser et al. | |
| 4,815,241 | A | | 3/1989 | Woodson | |
| 4,817,342 | A | * | 4/1989 | Martin et al. | 451/90 |
| 4,817,874 | A | | 4/1989 | Jarzebowicz | |
| 4,934,111 | A | * | 6/1990 | Hashish et al. | 451/102 |
| 4,955,164 | A | * | 9/1990 | Hashish et al. | 451/40 |
| 5,098,229 | A | | 3/1992 | Meier et al. | |
| 5,107,630 | A | * | 4/1992 | Lodewijk | 451/88 |
| 5,176,018 | A | | 1/1993 | Thompson | |
| 5,201,150 | A | | 4/1993 | Kuboyama et al. | |
| 5,239,788 | A | * | 8/1993 | Woodson | 451/39 |
| 5,407,379 | A | | 4/1995 | Shank et al. | |
| 5,468,066 | A | | 11/1995 | Hammonds | |
| 5,484,325 | A | * | 1/1996 | Shank | 451/38 |
| 5,643,058 | A | | 7/1997 | Erichsen et al. | |
| 5,800,246 | A | * | 9/1998 | Tomioka | 451/2 |
| 5,876,267 | A | | 3/1999 | Kanda | |
| 6,083,001 | A | | 7/2000 | Deardon et al. | |
| 6,098,677 | A | | 8/2000 | Wegman et al. | |
| 6,168,503 | B1 | * | 1/2001 | Pao et al. | 451/40 |
| 6,276,993 | B1 | | 8/2001 | Miller | |
| 6,280,302 | B1 | * | 8/2001 | Hashish et al. | 451/102 |
| 6,299,510 | B1 | | 10/2001 | Massenburg | |
| 6,328,638 | B1 | | 12/2001 | Hopkins et al. | |
| 6,361,416 | B1 | | 3/2002 | Hopkins et al. | |
| 6,425,804 | B1 | * | 7/2002 | Pettit et al. | 451/38 |
| 6,676,039 | B2 | * | 1/2004 | Lindsey et al. | 239/325 |
| 7,040,959 | B1 | | 5/2006 | Panuska et al. | |
| 7,094,135 | B2 | | 8/2006 | Chisum et al. | |
| 7,485,027 | B2 | * | 2/2009 | Miller | 451/38 |
| 7,815,490 | B2 | * | 10/2010 | Liu | 451/7 |
| 8,308,525 | B2 | | 11/2012 | Hashish et al. | |
| 8,342,912 | B2 | * | 1/2013 | Funatsu et al. | 451/89 |
| 2001/0030245 | A1 | | 10/2001 | Lindsey et al. | |
| 2003/0034122 | A1 | | 2/2003 | Asai | |
| 2005/0017091 | A1 | * | 1/2005 | Olsen et al. | 239/400 |
| 2006/0223423 | A1 | | 10/2006 | Dorfman et al. | |
| 2007/0218808 | A1 | * | 9/2007 | Shimizu et al. | 451/5 |
| 2009/0258582 | A1 | * | 10/2009 | Miller | 451/102 |
| 2009/0318064 | A1 | * | 12/2009 | Hashish | 451/36 |
| 2012/0196516 | A1 | | 8/2012 | Funatsu et al. | |
| 2012/0252326 | A1 | * | 10/2012 | Schubert et al. | 451/60 |
| 2012/0282845 | A1 | | 11/2012 | Whang et al. | |
| 2013/0267152 | A1 | | 10/2013 | Tera et al. | |
| 2014/0045409 | A1 | | 2/2014 | Zhang et al. | |

FOREIGN PATENT DOCUMENTS

| | | | |
|---|---|---|---|
| GB | 2198975 | A | 6/1988 |
| JP | 2012157956 | A | 8/2012 |
| WO | WO 02/085572 | | 10/2002 |
| WO | WO03011524 | | 2/2003 |
| WO | WO 2009/050251 | | 4/2009 |

OTHER PUBLICATIONS

U.S. Appl. No. 13/038,779, filed Mar. 2, 2011, Liu.

European Patent Office Communication enclosing extended European Search Report and Opinion for Application No. 11170744.4, Applicant: Omax Corporation, mailed Feb. 20, 2015, 8 pages.

Australian Patent Examination Report No. 1 for Application No. 2011203006, Applicant: Omax Corporation, issued Jan. 9, 2015, 5 pages.

* cited by examiner

SYSTEMS FOR ABRASIVE JET PIERCING AND ASSOCIATED METHODS

CROSS-REFERENCE TO RELATED APPLICATION(S)

The present application claims priority to U.S. Provisional Patent Application No. 61/357,068, titled "SYSTEMS FOR ABRASIVE WATERJET PIERCING AND ASSOCIATED METHODS," filed Jun. 21, 2010, which is incorporated herein by reference in its entirety.

TECHNICAL FIELD

The present disclosure is directed generally to abrasive jet systems and associated components and methods, and more particularly to abrasive jet systems configured for piercing and cutting target materials.

BACKGROUND

Abrasive jet or waterjet systems have a cutting head that produces a high-velocity fluid jet or waterjet that can be used to cut or pierce workpieces composed of a wide variety of materials. Abrasives can be added to the waterjet to improve the cutting or piercing power of the waterjet. Adding abrasives results in an abrasive-laden waterjet referred to as an "abrasive waterjet" or an "abrasive jet." Abrasives are generally drawn into the abrasive water jet by air flow resulting from a low pressure (vacuum) generated by the Venturi effect of pressurized water flowing through the abrasive cutting head. Abrasives are typically metered to the open end of a conduit, such as a tube, coupled to the abrasive water jet cutting head and "vacuumed" into a mixing chamber to be combined with the high pressure fluid and expelled through a mixing tube or nozzle and directed against a workpiece.

Certain materials, such as composite materials and brittle materials, may be difficult to pierce with an abrasive jet. An abrasive jet directed at a workpiece composed of such material strikes a surface of the workpiece and begins forming a cavity. As the cavity forms, a hydrostatic pressure may build within the cavity. This hydrostatic pressure may act upon sidewalls of the cavity and negatively impact the workpiece material. In the case of composite materials such as laminates, such hydrostatic pressure may cause composite layers to separate or delaminate from one another as the hydrostatic pressure exceeds the tensile strength of the weakest component of the materials, which is typically the composite binder. In the case of brittle materials such as glass, polymers, and ceramics, the hydrostatic pressure may cause the material to crack or fracture. Other aspects or effects of the abrasive jet other than the hydrostatic pressure may, in addition or as an alternative to the hydrostatic pressure, cause or result in damage to the material during abrasive jet piercing operations.

Conventional techniques for mitigating piercing damage to materials include low pressure piercing, pressure ramping and vacuum assist devices. Low pressure piercing generally involves operating the abrasive water jet cutting system at a lower pressure for piercing than cutting. Once piercing is completed, pressure increases and cutting commences. Pressure ramping can involve using a reduced water pressure to form the waterjet and ensuring that abrasives are fully entrained in the waterjet before the hydrostatic pressure reaches a magnitude capable of causing damage to the material being pierced. A vacuum assist device can be used to draw abrasive into a mixing chamber of a waterjet cutting head prior to the arrival of water into the mixing chamber. Such a technique can prevent a water-only jet from striking the surface of the material.

DETAILED DESCRIPTION

Figure 1A:
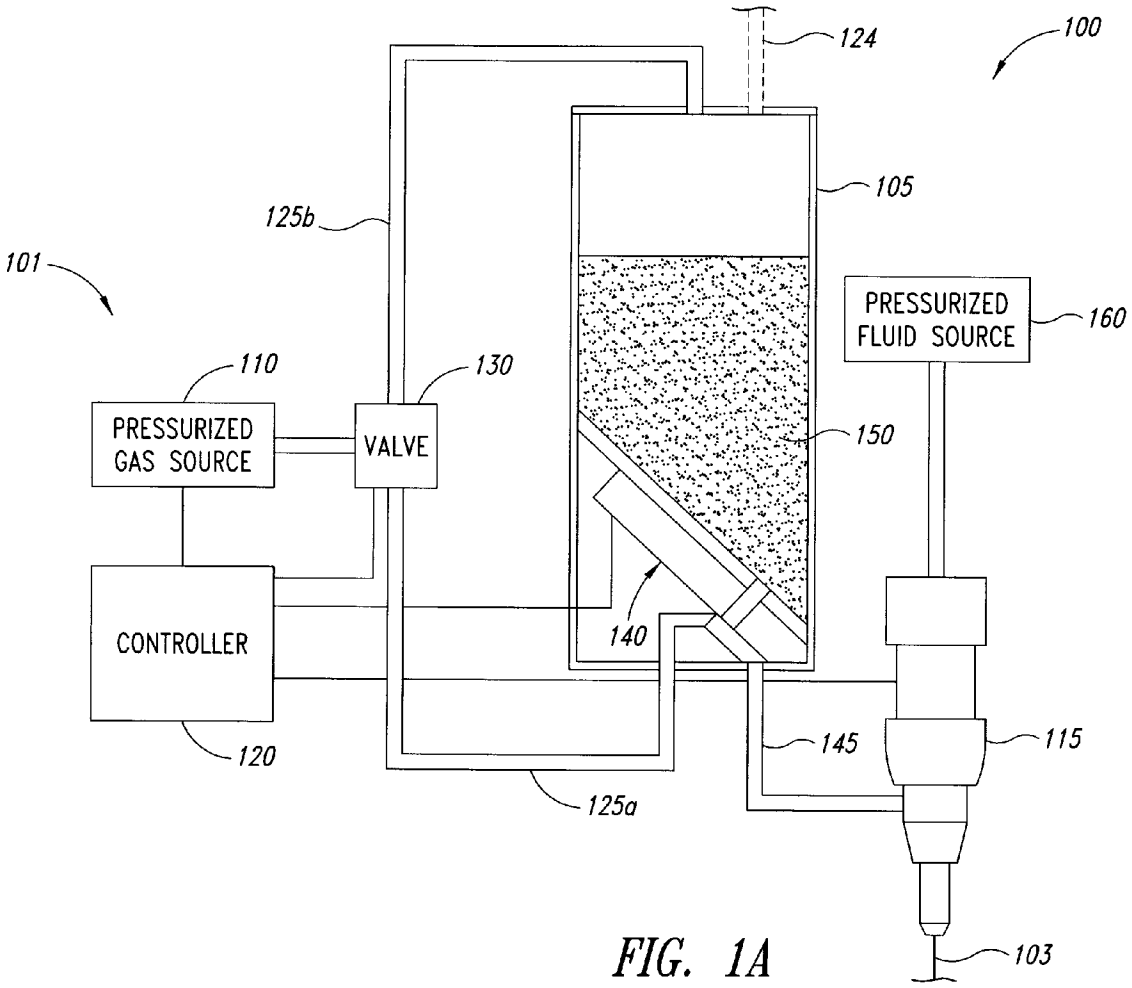
FIG. 1A is a schematic side view of a portion of an abrasive jet system configured in accordance with an embodiment of the disclosure.

This application describes various embodiments of abrasive jet systems and associated pressurized gas systems for piercing operations, such as piercing composite and brittle target materials. As used herein, the term "piercing" may refer to an initial penetration or perforation of the target material by the abrasive jet. For example, piercing may include removing at least a portion of the target material with the abrasive jet to a predetermined depth and in a direction that is generally aligned with or generally parallel to the abrasive jet. More specifically, piercing may include forming an opening or hole in an initial outer portion or initial layers of the target material with the abrasive jet. Piercing may also mean that the abrasive jet penetrates completely through the workpiece or target material as a preparatory action prior to cutting a slot in the material. Blind holes are when an abrasive waterjet is used to only partially pierce through a material to some depth that is less than the workpiece thickness. Moreover, the term "cutting" may refer to removal of at least a portion of the target material with the abrasive jet in a direction that is not generally aligned with or generally parallel to the abrasive jet. However, in some instances cutting can also include, after an initial piercing, continued material removal from a pierced opening with the abrasive jet in a direction that is generally aligned with or otherwise parallel to the abrasive jet. Once the material is pierced, cutting is generally performed by moving the head relative to the material perpendicular to the axis of the abrasive jet. In addition, abrasive jet systems as disclosed herein can be used with a variety of suitable working fluids or liquids to form the fluid jet. More specifically, abrasive jet systems configured in accordance with embodiments of the present disclosure can include working fluids such as water, aqueous solutions, paraffins, oils (e.g., mineral oils, vegetable oil, palm oil, etc.), glycol, liquid nitrogen, and other suitable abrasive jet fluids. As such, the term "water jet" or "waterjet" as used herein may refer to a jet formed by any working fluid associated with the corresponding abrasive jet system, and is not limited exclusively to water or aqueous solutions. In addition, although several embodiments of the present disclosure may be described below with reference to water, other suitable working fluids can be used with any of the embodiments described herein. Moreover, abrasive jet systems as disclosed herein can also be used with a variety of pressurized gas sources and particulate or abrasive sources to affect or influence the abrasive jet. For example, abrasive jet systems configured in accordance with embodiments of the present disclosure can include pressurized gases such as air, nitrogen, oxygen, or other suitable abrasive jet pressurizing gases. Certain details are set forth in the following description and in FIGS. 1A-5 to provide a thorough understanding of various embodiments of the technology. Other details describing well-known aspects of abrasive jet systems, however, are not set forth in the following disclosure so as to avoid unnecessarily obscuring the description of the various embodiments.

Many of the details, dimensions, angles, and other features shown in the Figures are merely illustrative of particular embodiments. Accordingly, other embodiments can have other details, dimensions, angles and features. In addition, further embodiments can be practiced without several of the details described below.

In the Figures, identical reference numbers identify identical, or at least generally similar, elements. To facilitate the discussion of any particular element, the most significant digit or digits of any reference number refer to the Figure in which that element is first introduced. For example, element 100 is first introduced and discussed with reference to FIG. 1.

One embodiment of the present disclosure is directed to an abrasive jet system that is configured to pierce target materials, such as brittle or delicate target materials, composite materials, etc. In one embodiment, an abrasive jet system includes a cutting head configured to receive abrasives and pressurized fluid to form an abrasive jet. The system also includes an abrasive source configured to store abrasives that are supplied to the cutting head, as well as a fluid source configured to store fluid that is supplied to the cutting head. The system further includes a gas source configured to store pressurized gas that is selectively supplied to the cutting head. When the gas source supplies the pressurized gas to the cutting head, the pressurized gas at least partially diffuses or otherwise affects the abrasive jet.

In another embodiment, an abrasive jet system can include a controller, an abrasive container, a cutting head, and an abrasive supply conduit operably coupled between the abrasive container and the cutting head. In some embodiments, the pressurized gas system includes a pressurized gas source operably coupleable to the abrasive supply conduit. The controller controls the pressurized gas source to increase the gas pressure in at least a portion of the abrasive supply conduit. Pressurized gas and abrasives from the abrasive container can flow through the abrasive supply conduit to the cutting head and can be mixed with a high-velocity fluid jet or waterjet to form an abrasive jet. The additional introduction of pressurized gas into the abrasive jet can at least partially diffuse, disperse, or otherwise affect the abrasive jet during piercing.

In some embodiments, the pressurized gas source is also operably coupleable to the abrasive container and further controllable by the controller to increase a pressure in the abrasive container. The system can also include a gas valve operably coupleable to the pressurized gas source, a first pressurized gas conduit operably coupleable to the valve and to the abrasive container, and a second pressurized gas conduit operably coupleable to the valve and to the abrasive supply conduit. The gas valve is controllable by the controller. The controller can cause the valve to open or vent, thereby equalizing a pressure of the pressurized gas system with atmospheric pressure, and to close, thereby allowing the pressure in the system to exceed atmospheric pressure.

In other embodiments, a method of operating an abrasive jet system is disclosed. The abrasive jet system can have a controller, an abrasive container, a cutting head, an abrasive supply conduit operably coupled between the abrasive container and the cutting head, and a pressurized gas source operably coupled to the abrasive supply conduit and controllable by the controller. The method can include transmitting one or more signals from the controller to the pressurized gas source to increase a pressure in at least a portion of the cutting head.

Embodiments of the present disclosure can include methods and systems that combine abrasives and pressurized fluid to form an abrasive jet, and that further selectively combine pressurized gas with the abrasive jet for piercing operations. The pressurized gas is configured to alter the abrasive stream in such a way that piercing damage to the target material is reduced or eliminated. Adding the pressurized gas to the abrasive jet can further entrain or collect more abrasives for the abrasive jet than would typically be added to the abrasive jet via the Venturi effect alone resulting from the pressurized fluid. Moreover, the addition of the pressurized gas into the abrasive jet can also supply the abrasives for the abrasive jet at a fluid pressure that is lower than a fluid pressure that would typically be required to entrain the abrasives due to the Venturi effect alone. Furthermore, the pressurized gas can be selectively or intermittently increased to clear a blockage in the system.

Abrasive Jet Systems and Associated Methods

FIG. 1A is a schematic side view of a portion of an abrasive jet system 100 ("system 100"). The system 100 includes a nozzle assembly or cutting head 115 that is operably coupled to each of a controller 120 and a pressurized fluid source 160 (e.g., a high-pressure fluid pump). The fluid source 160 is configured to supply a pressurized fluid, such as water or other suitable working liquids, to the cutting head 115. The system 100 also includes an abrasive container 105 that is coupled to the cutting head 115 via an abrasive supply conduit 145. The abrasive container 105 contains abrasives 150 that are combined with the working fluid at the cutting head 115 to form an abrasive fluid jet 103. The abrasives 150 can include garnet, aluminum oxide, baking soda, sugars, salts, ice particles, or other suitable jet cutting abrasives. The abrasive container 105 is coupled to the abrasive supply conduit 145 via an abrasive valve assembly 140 that can selectively open to allow the abrasives 150 to flow to the cutting head 115 through the abrasive supply conduit 145. The system 100 can also include an abrasive inlet connector or conduit 124 (shown in broken lines) that can be coupled to the abrasive container 105 to facilitate adding or feeding abrasives 150 to the abrasive container 105 from a bulk feeding device. The abrasive inlet conduit 124 can be sealed or otherwise closed off with reference to the abrasive container 105 (e.g., via a valve or other suitable device) to prevent a pressure drop in the abrasive container 105 during operation.

The system 100 further includes a pressurized gas system 101. The pressurized gas system 101 includes a pressurized gas source 110 (e.g., a compressor) that is operably coupled to the controller 120. The pressurized gas source 110 is configured to supply a pressurized gas, such as air or other suitable working gases, to the cutting head 115 and/or to the abrasive container 105. For example, a valve 130 operably couples the pressurized gas source 110 to corresponding pressurized gas supply conduits 125 (identified individually as a first gas supply conduit 125*a* and a second gas supply conduit 125*b*). The first gas supply conduit 125*a* couples the pressurized gas source 110 to the cutting head 115 via the abrasive supply conduit 145. The second gas supply conduit 125*b* couples the pressurized gas source 110 to the abrasive supply container 105. As described in detail below, the pressurized gas system 101 selectively supplies pressurized gas to the cutting head 115 to affect or alter the abrasive fluid jet emitted by the cutting head 115.

As shown in FIG. 1A, the controller 120 is operably coupled to several of the illustrated components of the system 100 via electrical wiring shown schematically in FIG. 1A, wireless connections, or other suitable connections. The controller 120 can also be operably coupled to other components of the abrasive jet system such as the high-pressure fluid source 160, as well as other components of the abrasive jet system not shown in FIG. 1A. For example, the controller can be operably coupled to a bridge that is movable along a table of the abrasive jet system and along which the cutting head 115 is movable, and other components as is known in the art. The controller 120 includes control software, firmware, and/or hardware for controlling components of the abrasive jet system 100. The controller 120 can include a computer having a processor, memory (e.g., ROM, RAM) storage media (e.g., hard drive, flash drive, etc.) user input devices (e.g., keyboard, mouse, touch-screen, etc.), output devices (e.g., displays), input/output devices (e.g., network card, serial bus, etc.), an operating system (e.g., a Microsoft Windows operating system), and application programs and data. The controller 120 can include layout software for generating and/or importing Computer-Aided Design (CAD) drawings or other suitable drawings or information from which cutting or piercing operations can be derived.

Figure 1B:
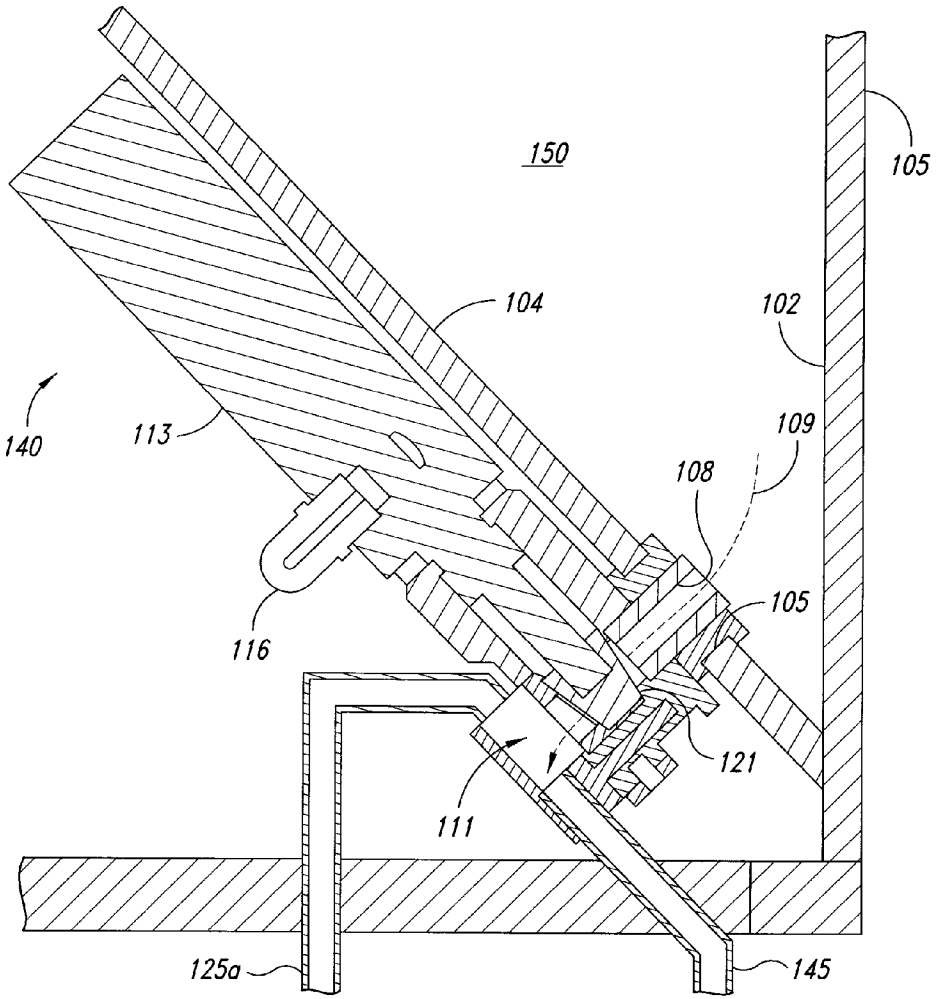
FIG. 1B is an enlarged schematic side view of a portion of the abrasive jet system of FIG. 1A.

FIG. 1B is an enlarged schematic side view of a portion of the system 100 of FIG. 1A. As seen in FIG. 1B, the abrasive the abrasive container 105 includes a first or bottom wall 104 angled obliquely with respect to a second or sidewall 102. The bottom wall 104 has an opening 105 that is coupled to the abrasive valve 140. The abrasive valve 140 at least partially defines a passage 108 through which the abrasives 150 can exit the abrasive container 105. More specifically, the abrasives 150 flow from the abrasive container 105 through the passage 108 to a collector portion 111 of the abrasive supply conduit 145, as shown by a broken arrow 109. The abrasive valve 140 includes an actuator 116 (e.g., a solenoid, gear motor, etc.) operably coupled to the controller 120 (FIG. 1A) and a gas cylinder 113. The abrasive valve 140 can further include a tapered plug or end portion 121 that is movable relative to the passage 108. The actuator 116 moves the end portion 121 to an open position, a closed position, or to an intermediate position to meter a flow of abrasives 150 through the passage 108 and into the abrasive supply conduit 145. In FIG. 1B, the end portion 121 is shown in the closed position to block or prevent the flow of abrasives 150 into the collecting portion 111 of the abrasive supply conduit 145. In other embodiments, the system 100 can include other devices for metering or dispensing the abrasives 150 from the abrasive container 150. For example, the system 100 can include one or more metering devices such as vibrators feeders, augers, drum feeders, variable sized orifices, and/or other suitable abrasive feeding devices.

Referring to FIGS. 1A and 1B together, in operation the controller 120 transmits control signals to each of the pressurized fluid source 160 and the abrasive valve 140 to form the abrasive jet 103 for processing (e.g., piercing, cutting, engraving, marking, etc.). For certain processes, such as for piercing or initially cutting the target material, the controller can further transmit control signals to the pressurized gas source 110 and/or the valve 130 to convey the pressurized gas to the cutting head 115 via the first pressurized gas supply conduit 125*a* and the abrasive delivery conduit 145. The controller 115 can also transmit signals to direct the valve 130 to dispense pressurized gas to the abrasive container 105 via the second pressurized gas supply conduit 125*b*. As such, in certain embodiments the system 100 can maintain an at least generally zero net pressure differential across the passage 108 of the abrasive valve 140. More specifically, when the valve 130 directs the pressurized gas to each of the pressurized gas supply conduits 125, the pressure upstream from the abrasive valve 140 (e.g., in the abrasive container 105) can be controlled to be equivalent, or at least generally equivalent to the pressure downstream from the abrasive valve 140 (e.g., in the abrasive delivery conduit 145) so that there is not a pressure drop across the abrasive valve 140.

When the system 100 maintains the generally zero net pressure differential across the abrasive valve 140, the system 100 can also maintain a generally constant flow of the abrasives 150 exiting the abrasive container 105 during a transition when the system 100 activates or deactivates the pressurized gas source 110. As a result, the system 100 can maintain a generally constant flow of abrasive 150 in the abrasive jet 103 with little to no interruption when the controller 120 activates or deactivates the pressurized gas source 110. In certain embodiments, for example, the system 100 activates the pressurized gas source 110 to add pressurized gas to the abrasive jet 103 for a startup or piercing the target material. After the abrasive jet 103 pierces the target material or otherwise removes material to an appropriate initial depth, the system 100 can deactivate the pressurized gas source 110 to remove or eliminate the pressurized gas from the abrasive jet 103. Further details regarding the effect of the pressurized gas on the abrasive jet are described below with reference to FIGS. 1C and 1D. In other embodiments, the system 100 can maintain a pressure differential across the abrasive valve 140. For example, the pressurized gas valve 130 can increase the pressure upstream from the abrasive valve 140 (e.g., in the abrasive container 105) relative to the pressure downstream from the abrasive valve 140 (e.g., in the abrasive delivery conduit 145) to maintain, increase, or otherwise alter the flow of abrasives 150 from the abrasive container 105.

Figure 1D:
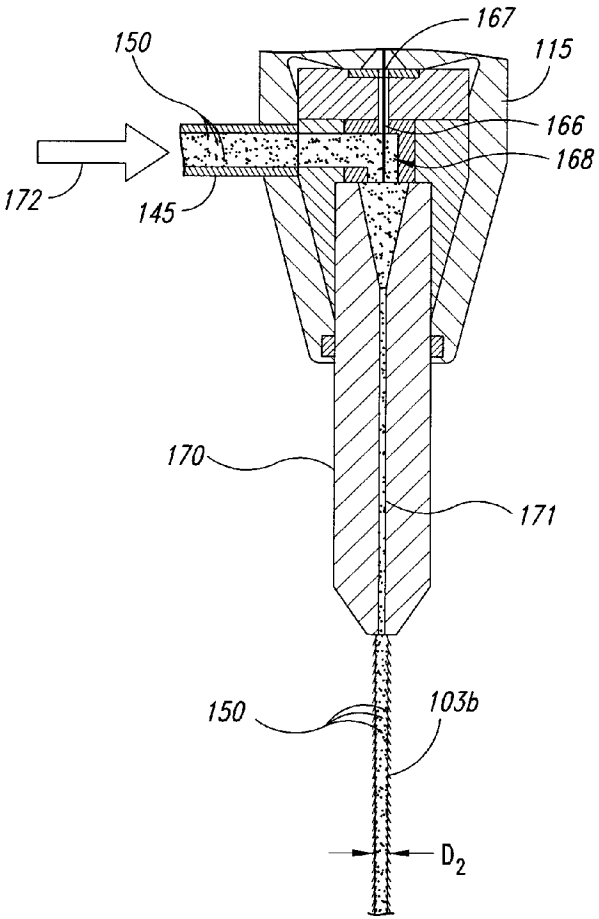
FIGS. 1C and 1D are cross-sectional side views of a portion of the abrasive jet system of FIG. 1A illustrating the effect that pressurized gas can have on an abrasive jet emitted from a cutting head.
Figure 1C:
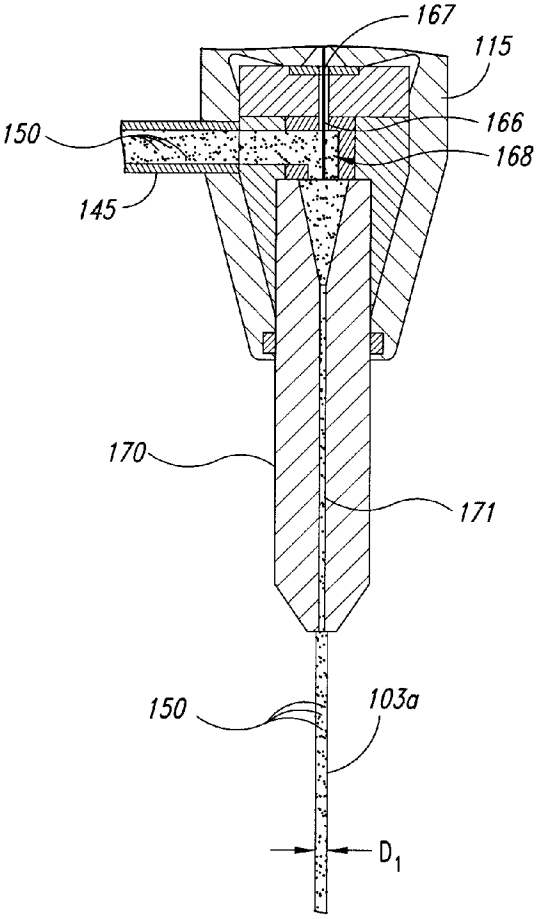

Without being bound by theory, FIGS. 1C and 1D illustrate the apparent effect that the pressurized gas can have on the abrasive jet 103 in one embodiment. More specifically, FIG. 1C is a cross-sectional side partial view of the cutting head 115 of FIG. 1A during operation without the addition of the pressurized gas to the cutting head 115. The cutting head 115 includes a mixing tube 170 that is fluidly coupled to the abrasive supply conduit 145. The mixing tube 171 includes an axial passage that is generally aligned with a fluid orifice 167 in the cutting head 115. In operation, a pressurized fluid stream or jet 166 enters the cutting head 115 via the fluid orifice 167, and abrasives 150 enter the cutting head 115 via the abrasive supply conduit 145 because of the Venturi effect. The abrasives 150 combine with the fluid jet 166 at a mixing region 168 of the cutting head 115. The combined abrasives 150 and fluid jet 166 pass through the axial passage 171 and exit the mixing tube 170 as a first abrasive jet 103*a*. In the embodiment illustrated in FIG. 1C, pressurized gas from the pressurized gas source 110 (FIG. 1A) has not been supplied to the cutting head 115 or the first abrasive jet 103*a*. As a result, the first abrasive jet 103*a* illustrated in FIG. 1C has a generally uniform, constant, and/or consistent stream or appearance. For example, the first abrasive jet 103*a* has a first cross-sectional dimension or diameter $D_1$ that is generally constant extending from the mixing tube 170 to the surface of the target material.

FIG. 1D is also a cross-sectional side partial view of the cutting head 115. In FIG. 1D, however, pressurized gas 172 enters the cutting head 115 along with the abrasives 150 via the abrasive supply conduit 145. The pressurized gas 172 and abrasives 150 combine with the pressurized fluid stream 166 at the mixing region 168. The combined pressurized gas 172, abrasives 150, and fluid jet 166 exit the mixing tube 170 as a second type of abrasive jet 103*b*. Unlike the first abrasive jet 103*a* of FIG. 1C, the second abrasive jet 103*b* illustrated in FIG. 1D can have a slightly irregular or mildly dispersed or mildly diffused appearance. For example, the second abrasive jet 103*b* can have a second cross-sectional dimension $D_2$ that is slightly irregular or slightly diffused at various positions extending along the second abrasive jet 103*b* from the mixing tube 170 to the surface of the target material. One of ordinary skill in the art will appreciate that the first and second abrasive jets 103*a*, 103*b* shown in FIGS. 1C and 1D may have exaggerated sizes and/or features for purposes of illustration to show the apparent effect of the presence or absence of the pressurized gas 172 on the abrasive jet streams exiting the mixing tube 170 in some embodiments.

Systems configured in accordance with embodiments of the disclosure can accordingly function in at least two different operational modes. For example, a first mode of operation can be without the pressurized gas added to the first abrasive stream 103*a* as shown in FIG. 1C. At least a second mode can include pressurized gas 172 that is added to the second abrasive jet 103*b* as shown in FIG. 1D. In certain embodiments the first and second operational modes can include approximately the same amount of abrasive 150 entrained in the corresponding abrasive jets 103*a*, 103*b*. Stated differently, the abrasive flow rate, as well as the fluid flow rate, can remain approximately equal in the first and second operational modes. In other embodiments, however, these flow rates can differ with the first and second operational modes. In still further embodiments, however, piercing and cutting operations can each be accomplished with the pressurized gas flow added to the abrasive jet.

The addition of the pressurized gas in the second abrasive jet 103*b* is configured to alter the abrasive stream in such a way that piercing damage to the target material is reduced or eliminated. Adding the pressurized gas to the abrasive jet 130*b* can further entrain or collect more abrasives 150 for the abrasive jet 103*b* than would typically be added to the abrasive jet 103*b* via the Venturi effect alone resulting from the pressurized fluid. For example, the pressurized gas can collect and/or direct the abrasives 150 to the cutting head 115. Moreover, the addition of the pressurized gas into the cutting head 115 can also supply the abrasives 150 for the abrasive jet 103*b* at a fluid pressure of the jet stream 166 that is lower than a fluid pressure of the jet stream 166 that would typically be required to entrain the abrasives 150 due to the Venturi effect alone. Furthermore, according to additional embodiments of the disclosure, the pressurized gas can be selectively or intermittently increased to clear a blockage in the system. In still further embodiments, the pressurized gas can transport the abrasives 150 to the mixing region 168 in the cutting head 115 before the jet stream 166 is initiates so that when the jet stream 166 is activated the abrasive jet 130 is immediately formed due to the presence of the abrasives 150 in the mixing region 168.

One of the challenges of abrasive jets or waterjets is their tendency to induce damage during piercing delicate materials. Certain materials, such as composites, laminates, and/or brittle materials may be difficult to pierce with an abrasive jet. Embodiments of the present disclosure, however, are able to mitigate or eliminate piercing damage to the target material. For example, although the presence of the pressurized gas 172 in the second mode of operation may degrade or otherwise diminish the quality of the second abrasive jet 103*b*, the inventors have found that the second abrasive jet 103*b* is particularly suited for piercing. More specifically, the second abrasive jet 103*b* or second operational mode particularly suited for mitigating piercing damage with delicate materials, such as composite, laminate, and/or brittle materials. Moreover, the first abrasive jet 103*a* or first operational mode particularly suited for continuing to cut or otherwise removing material following an initial piercing operation.

Conventional techniques used to mitigate piercing damage to materials include lower pressure piercing, pressure ramping and vacuum assist devices. Low pressure piercing may involve piercing the material with an abrasive jet at a lower fluid pressure than would typically be used for cutting. Pressure ramping can involve using a reduced water pressure to form the waterjet in an attempt to ensure that abrasives are fully entrained in the waterjet before a hydrostatic pressure induced by fluid water alone reaches a magnitude capable of causing damage to the material being pierced. A vacuum assist device can also be used to draw abrasive into a mixing chamber of a waterjet cutting head prior to the arrival of water into the mixing chamber. Such a technique attempts to ensure that a water-only jet does not strike the surface of the material. Other piercing damage mitigation techniques include superheating high pressure water downstream of the pump and upstream of the nozzle such that the pressurized high-temperature water remains in the liquid state upstream of the inlet orifice in the nozzle and then evaporates upon exiting the nozzle, as disclosed in U.S. Pat. No. 7,815,490, which is incorporated herein by reference in its entirety. As a result, only high-speed abrasives and very little liquid water enters the cavity or blind hole in the delicate material. Therefore, the hydrostatic pressure buildup inside the cavity is minimized leading to the mitigation of piercing damage to delicate materials. Yet another piercing damage mitigation technique involves pressurized abrasive feeding to degrade the abrasive jet in a controlled manner, as disclosed in U.S. Provisional Patent Application No. 61/390,946, entitled "SYSTEMS AND METHODS FOR ALTERING AN ABRASIVE JET FOR PIERCING OF DELICATE MATERIALS," filed Oct. 7, 2010, and incorporated by reference herein in its entirety. The alteration of the abrasive jet via pressurized abrasives is believed to reduce the magnitude of the hydrostatic pressure inside a cavity while the pressurized abrasive feeding would ensure an abrasive waterjet is formed before reaching the workpiece ensuring a fluid alone does not reach the material before abrasives are mixed with the fluid.

Figure 2A:
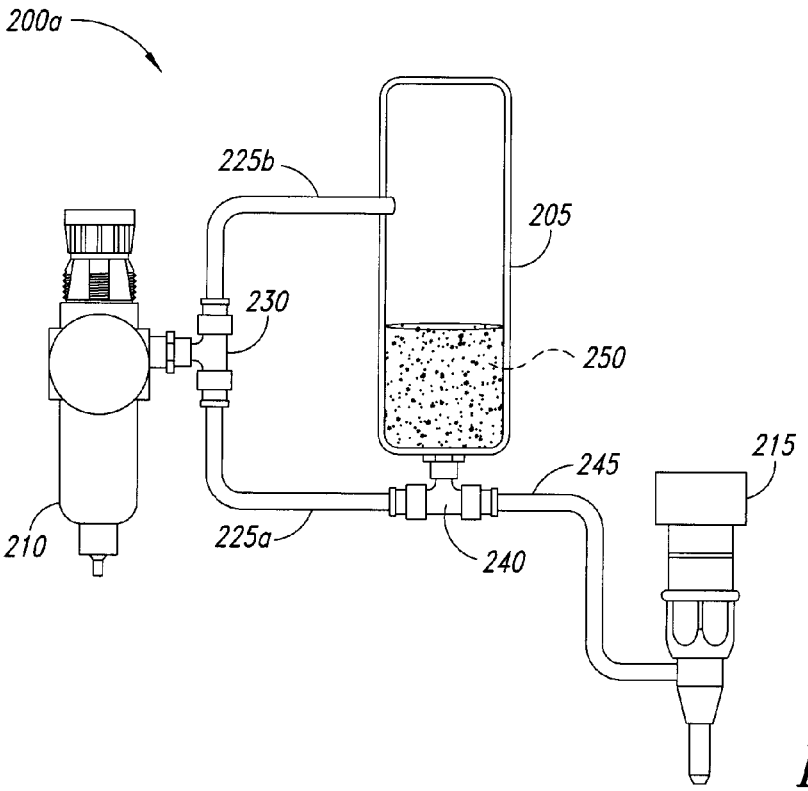
FIG. 2A is a side view of an abrasive jet system configured in accordance with another embodiment of the disclosure.

FIGS. 2A-4 illustrate various abrasive jet systems configured in accordance with embodiments of the disclosure. The systems illustrated in FIGS. 2A-4 include several features that are generally similar in structure and function to the corresponding features of the system 100 described above with reference to FIGS. 1A-1D. For example, FIG. 2A is a side view of an abrasive jet system 200*a* ("system 200*a*") including a pressurized gas source 210 that is coupled to an abrasive container 205 and a cutting head 215. A gas valve, regulator, or connector 230 couples the pressurized gas source 210 to each of a first pressurized gas supply conduit 225*a* and a second pressurized gas supply conduit 225*b*. The first pressurized gas supply conduit 225*a* couples the gas source 210 to the abrasive container 205 via an abrasive connector 240. The second pressurized gas supply conduit 225*b* couples the gas source 210 directly to the abrasive container 205 upstream from the abrasive connector 240. In addition, an abrasive supply conduit 245 couples the abrasive connector 240 to the cutting head 215 to deliver abrasives 250 to the cutting head 215. A pressurized fluid source (not shown) can also be coupled to the cutting head 215 to combine a pressurized fluid with the abrasives 250 to form the abrasive jet that is emitted from the cutting head 215. The system 200*a* can further include a controller (not shown) that is operably coupled to one or more of the operable components of the system 200*a*.

In one aspect of the embodiment illustrated in FIG. 2A, the abrasive connector 240 can be a relatively simple or uncomplicated mechanical connector, such as a tee fitting or a tee coupling. As such, the abrasive connector 240 forms a junction between the first pressurized gas supply conduit 225*a*, the abrasive container 205, and the abrasive supply conduit 245. The abrasive connector 240 can therefore deliver the abrasives 250 to the abrasive supply conduit 245 without any moving parts or complicated on/off functionality. Moreover, in certain embodiments, the gas connector 230 can be generally similar in structure and function to the abrasive connector 240. In operation, the system 200*a* can operate in a manner generally similar to the operation of the system 100 described above with reference to FIGS. 1A-1D. For example, the cutting head 215 can emit an abrasive jet including abrasives 250 combined with a pressurized fluid. In some modes of operation, such as for piercing a target material, the pressurized gas source 210 can supply a pressurized gas to the cutting head 215 via the first pressurized gas supply conduit 225*a* and the abrasive supply conduit 245. The pressurized gas source 210 can also supply the pressurized gas to the abrasive container 205 via the second pressurized gas supply conduit 225*b*.

Figure 2B:
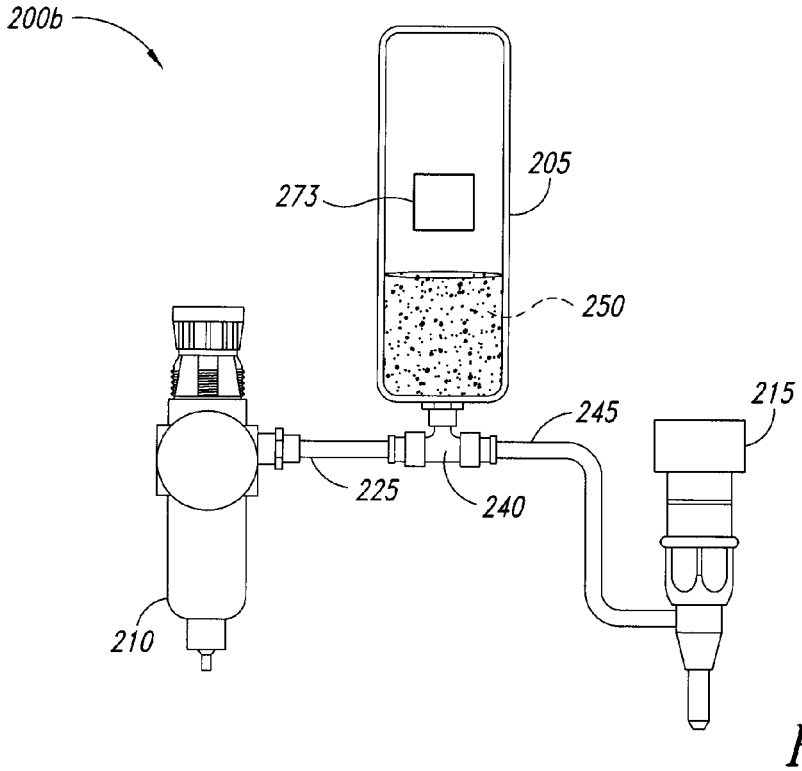
FIGS. 2B and 2C are partially schematic side views of abrasive jet systems configured in accordance with additional embodiments of the disclosure.

FIG. 2B is a side partially schematic view of an abrasive jet system 200*b* ("system 200*b*") configured in accordance with another embodiment of the disclosure. The abrasive system 200*b* includes the same features as the system 200*a* described above with reference to FIG. 2A, with the exception that the pressurized gas source 210 is not coupled to the abrasive container 250 upstream from the abrasive connector 240. More specifically, only a single pressurized gas supply conduit 225 is coupled to the pressurized gas source 210. The pressurized gas supply conduit 225 is further coupled to the abrasive connector 240. The abrasive connector 240 is further coupled to the abrasive container 205 to deliver the abrasives 250 to the cutting head 215. According to another feature of the illustrated embodiment, the system 200*b* can include an abrasive flow assister 273 (shown schematically). The abrasive flow assister 273 is configured to assist or facilitate the flow of the abrasives 250 from the abrasive container 205 to the abrasive connector 240 and the abrasive supply conduit 245. For example, the abrasive flow assister 273 can be an agitator, vibrator, auger, fluidizer, or other suitable device for assisting or otherwise flowing the abrasives out of the abrasive container 205. In still further embodiments, the system 200*b* can function solely as a gravity abrasive feed system without the abrasive flow assister 273. In operation, the pressurized gas source 210 can supply pressurized gas to the cutting head 215 to combine with the abrasive jet for certain processing operations, such as for piercing for example.

Figure 2C:
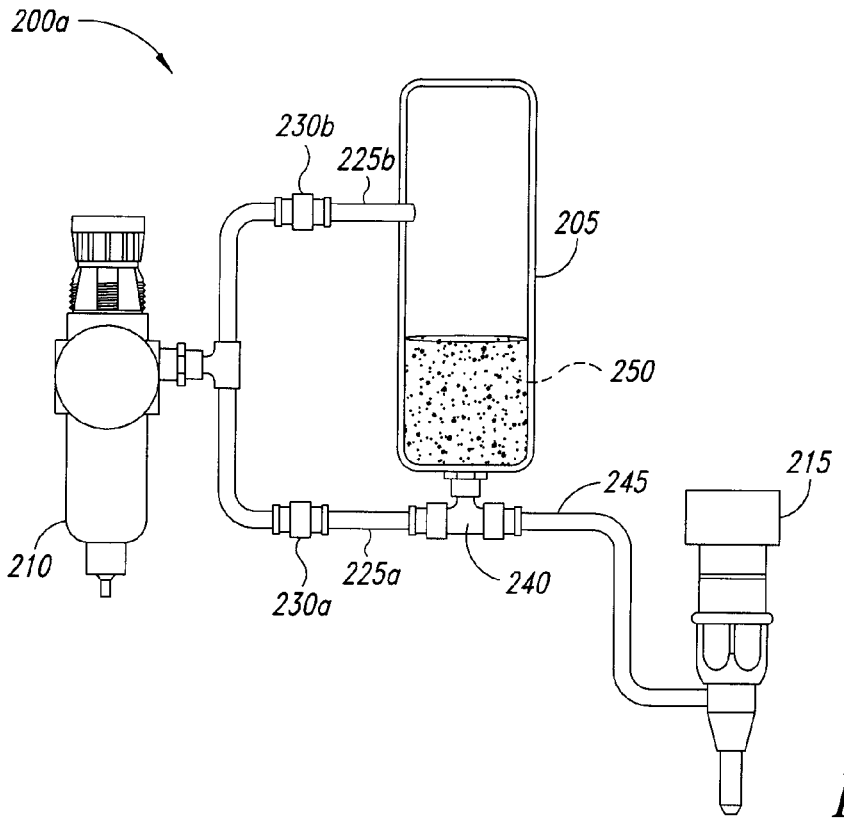

FIG. 2C is a side partially schematic view of an abrasive jet system 200*c* ("system 200*c*") configured in accordance with another embodiment of the disclosure. The abrasive system 200*c* includes the same features as the system 200*a* described above with reference to FIG. 2A, with the exception that the pressurized gas source 210 is coupled to the first pressurized gas conduit 225*a* via a first valve or regulator 230*a*, and to the second pressurized gas conduit 225*b* via a second valve or regulator 230*b*. The first and second valves 230 can be operably coupled to a corresponding controller. As such, the first and second valves 230 can be independently controlled to direct or otherwise control the flow of the pressurized gas to each of the abrasive container 205 and the cutting head 215.

Figure 3A:
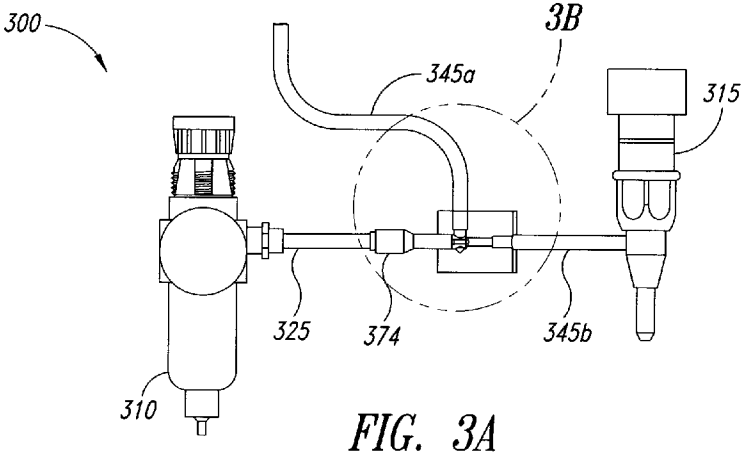
FIG. 3A is a side view of an abrasive jet system configured in accordance with an additional embodiment of the disclosure.

FIG. 3A is a side view of an abrasive jet system 300 ("system 300") configured in accordance with an additional embodiment of the disclosure. The system 300 includes a cutting head 315 that is coupled to a pressurized gas source 310 and an abrasive supply container (not shown). The system 300 further includes a nozzle 374 that directs pressurized gas to combine with abrasives. More specifically, a pressurized gas supply conduit 325 couples the pressurized gas source 310 to the nozzle 374. A first abrasive supply conduit 345*a* couples the abrasive container to the nozzle 374. A second abrasive supply conduit 345*b* couples the nozzle 374 to the cutting head.

Figure 3B:
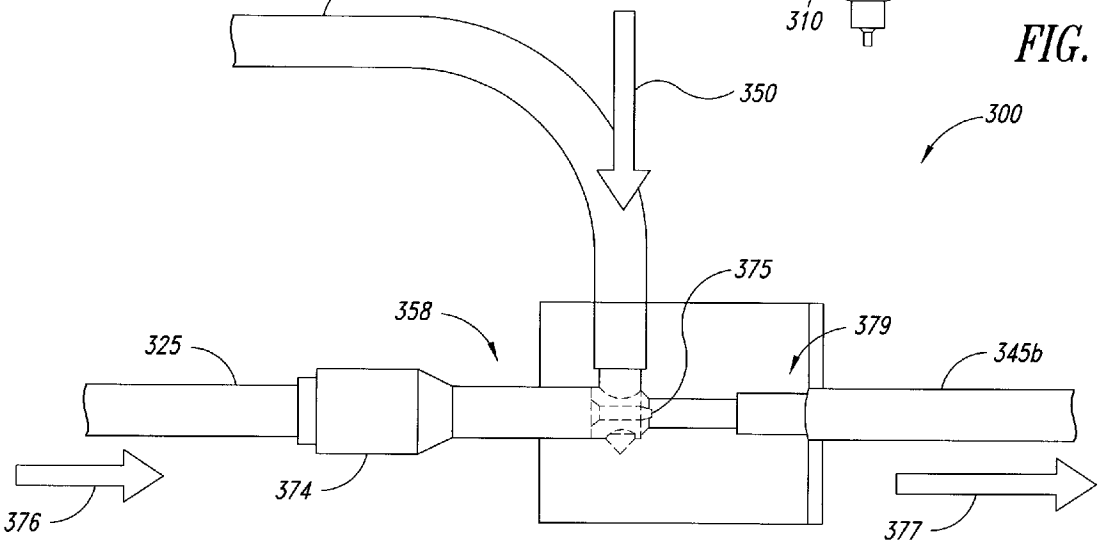
FIG. 3B is an enlarged side view of a portion of the system 300 of FIG. 3A.

FIG. 3B is an enlarged view of a portion of the system 300 of FIG. 3A illustrating the connection of the nozzle 374 to each of the pressurized gas supply conduit 325 and the first and second abrasive supply conduits 345*a*, 345*b*. The nozzle 374 directs pressurized gas 376 from the pressurized gas supply conduit 325 to combine with abrasives form the first abrasive supply conduit 345*a* to flow through the second abrasive supply conduit 345*b*. In certain embodiments, the nozzle 374 can be an eductor, jet pump, or other suitable device for combining the 350 and pressurized gas 376 with the abrasives 350 downstream and/or spaced apart from the abrasive container 305. In the illustrated embodiment, the nozzle 374 includes a converging portion 378, a jet or needle valve 375, and a diverging portion 379. In operation, the nozzle 374 can utilize the Venturi effect to create a low pressure zone in the gas 376 that draws in and entrains the abrasives into the gas flow 376. The combined abrasives and gas 377 can then be delivered to the cutting head (FIG. 3A) via the second abrasive supply conduit 345*b*.

Figure 4B:
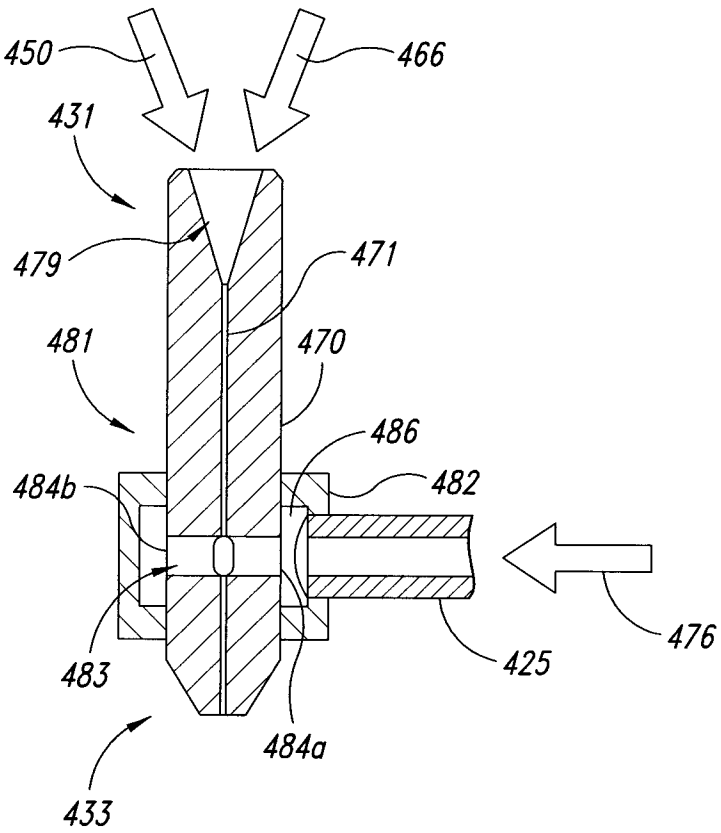
FIG. 4B is a cross-sectional side view of the mixing tube subassembly of FIG. 4A.
Figure 4A:
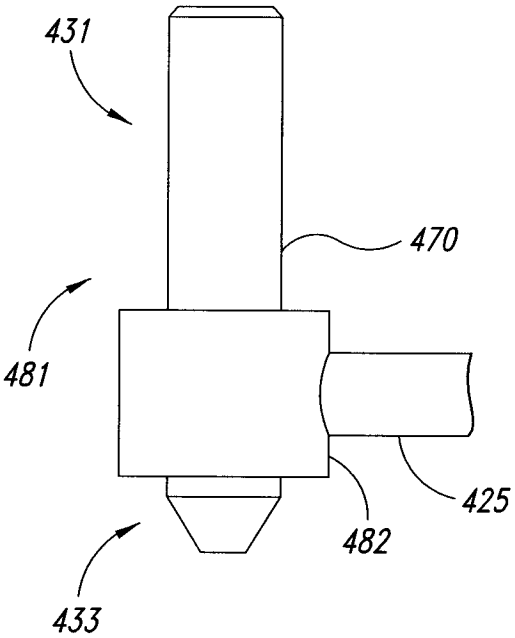
FIG. 4A is a side view of a mixing tube subassembly configured in accordance with an embodiment of the disclosure.

FIG. 4A is a side view and FIG. 4B is a cross-sectional side view of a mixing tube subassembly 481 ("subassembly 481"). Referring to FIGS. 4A and 4B together, the subassembly 481 includes a mixing tube 470 having several features that are generally similar in structure and function to the mixing tube 170 described above with reference to FIGS. 1C and 1D. For example, the mixing tube 470 illustrated in FIGS. 4A and 4B includes an axial passage 471 extending longitudinally therethrough from a proximal end portion 431 to a distal end portion 433 of the mixing tube 470. The mixing tube 470 further includes an inlet region 479 at the proximal end portion 431 that is configured to receive abrasives 450 and pressurized fluid 466 to form an abrasive jet that exits the proximal end portion 433 of the mixing tube 470.

According to additional features of the illustrated embodiment, the subassembly also includes a gas conduit coupling 482 that is configured to couple the mixing tube 470 to a pressurized gas supply conduit 425. More specifically, and with reference to FIG. 4B, the distal end portion 433 of the mixing tube 470 includes a latitudinal passage 483 extending from a first opening 484*a* to a second opening 484*b*. The latitudinal passage 483 extends in a direction that is generally transverse to the longitudinal axis of the mixing tube 470. The latitudinal passage 483 further includes a jet stream recess 485 in a central portion of the latitudinal passage 483 that is generally aligned with the axial passage 471. The gas conduit coupling 482 couples directly to the gas supply conduit 428 and encircles the distal end portion 433 of the mixing tube 471 proximate to the openings 484. An interior surface 486 of the gas conduit coupling 482 at least partially defines a cavity that encircles or surrounds the distal end portion 433 of the mixing tube 470 at a location that covers the openings 484. As such, the gas conduit coupling 482 fluidly connects the gas supply conduit 425 to the distal end portion 433 of the mixing tube 470 at a location that is generally aligned with the latitudinal passage 483.

In operation, abrasives 450 and pressurized fluid 466 enter the proximal end portion 431 of the mixing tube 470 to form an abrasive jet. Pressurized gas 476 can enter the distal end portion 433 of the mixing tube 470 via the gas supply conduit 425 and gas conduit coupling 482 during certain operational modes, such as during piercing. The pressurized gas can enter the distal end portion 433 of the mixing tube 470 via the latitudinal passage 483 and mix or otherwise combine with the abrasive jet at the jet stream recess 485. Accordingly, the pressurized gas 476 enters the mixing tube 433 at a location that is downstream from and also separate from the location where abrasives 450 enter the mixing tube 470. As such, the pressurized gas 476 can be added to the fluid jet 466 independently from the abrasives 450.

Figure 5:
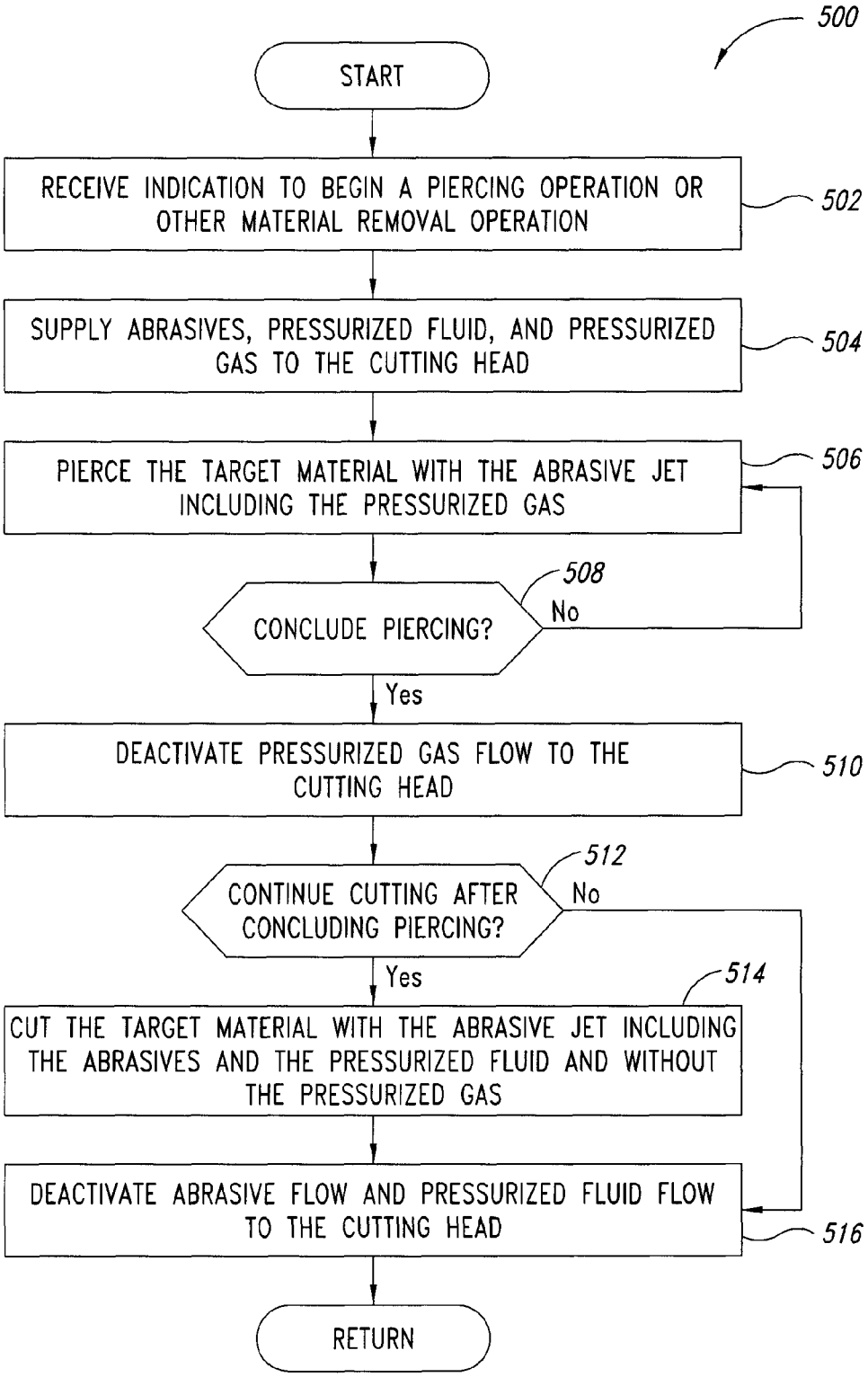
FIG. 5 is a flow diagram of a process configured in accordance with embodiments of the disclosure.

FIG. 5 is a flow diagram of a method or process 500 configured in accordance with embodiments of the present disclosure for piercing and cutting operations using abrasive jet systems as disclosed herein. The process 500 includes receiving an indication to begin a piercing operation or other material removal operation with an abrasive jet system (block 502). The indication to begin the piercing operation can be received from an operator of the abrasive jet system, control software of the controller, or from any other suitable source. The process 500 further includes supplying abrasives from an abrasive supply, pressurized fluid from a pressurized fluid supply, and pressurized gas from a pressurized gas supply to the cutting head of the abrasive jet system (block 504). In certain embodiments, the abrasives, pressurized fluid, and pressurized gas are supplied to the cutting head to arrive at the target material at the same time. In other embodiments, however, the order of the flow of abrasives, pressurized fluid, and pressurized gas to the cutting head can vary. For example, the pressurized gas can be supplied to the cutting head after the abrasives and pressurized fluid are supplied to the cutting head. In other embodiments, the abrasives, pressurized fluid, and pressurized gas can be supplied in any suitable order for combining these constituents to form the abrasive jet that is configured for piercing. In still further embodiments, the order of the abrasives, pressurized fluid, and pressurized gas can be controlled to ensure that the pressurized fluid alone does not reach the target material (e.g., without the abrasives or the pressurized gas). For example, the abrasives and pressurized fluid may be combined and/or directed to the target material prior to the addition of the pressurized fluid to the abrasive jet.

Moreover, in certain embodiments, the abrasives and pressurized gas can at least partially combine upstream from the cutting head and be supplied to the cutting head via the same supply conduit. In other embodiments, however, the pressurized gas can be supplied to the cutting head separately from the abrasives and the pressurized fluid. More specifically, in one embodiment the pressurized gas can be supplied to the cutting head downstream from the ingress of the abrasives and/or pressurized gas into the cutting head. In other embodiments, however, the pressurized gas can enter the cutting head upstream from the ingress of the abrasives and/or pressurized fluid into the cutting head. In still further embodiments, pressurized gas can also be supplied to the abrasive container (in addition to the cutting head) at a location that is upstream from an abrasive outlet of the abrasive container. As such, the pressurized gas source can maintain a generally net zero pressure differential or otherwise prevent a pressure drop across the abrasive container.

According to additional aspects of the process 500, the pressurized gas source can provide gas at various pressures, such as from approximately 5 PSI or less to approximately 120 PSI or more. The gas pressure can depend upon various factors, such as the type or thickness of the target material, an inside diameter of a passage of the mixing tube of the cutting head, size of the pierced hole, abrasive jet kerf, etc. For example, the controller may provide gas at a relatively lower pressure (e.g., from approximately 10 PSI to approximately 50 PSI) for mixing tubes with relatively smaller inside diameters, and gas at a relatively higher pressure (e.g., from approximately 40 PSI to approximately 100 PSI) for mixing tubes with relatively larger inside diameters. Moreover, in some embodiments, the introduction of pressurized gas into the waterjet does not cause or otherwise result in a phase change (e.g., from liquid to gas) of the fluid in the abrasive jet. According to further aspects of the process 500, the pressure of the fluid provided by the pressurized fluid, the abrasive flow rate provided by the abrasive source, and/or the pressure of the gas provided by the pressurized gas source can vary based on various factors. These factors can include, for instance, the type or thickness of the target material, a kerf size of the abrasive jet, an inside dimension of a passage of a mixing tube of the cutting head, required piercing and cutting speed or quality, as well as other factors. In some embodiments, for example, a relatively low fluid pressure (e.g., from approximately 3,000 PSI or less to approximately 5,000 PSI or more) can be used, or a higher fluid pressure (e.g., from approximately 10,000 PSI to approximately 50,000 PSI or more) can be supplied to form the abrasive jet. The abrasive jet system can also vary the fluid delivery pressure, gas delivery pressure, abrasive delivery flow rate, as well as the rate at which these constituents change based on these and other factors. The process 500 can further include controlling an external bulk hopper to maintain an abrasive supply for the system.

The addition of the pressurized gas to the abrasive jet can allow for piercing operations at fluid pressures that are lower than typical piercing fluid pressures for abrasive jets. For example, the fluid pressure in piercing operations may typically be approximately 40,000 PSI or greater, and for low pressure piercing operations it may typically be 20,000 PSI or greater. According to embodiments of the present disclosure, however, during piercing operations the fluid pressure can be reduced even further. For example, during piercing operations the fluid pressure can be reduced from approximately 1,000 PSI to approximately 10,000 PSI or from approximately 2,000 PSI to approximately 5,000 PSI. Even at these relatively low fluid pressures, the addition of the pressurized fluid can provide supply the suitable amount of abrasives to the abrasive jet for piercing.

The process 500 further includes piercing the target material with the abrasive jet (block 506). Piercing the target material, and in particular piercing target materials that are brittle or delicate, includes adding the pressurized gas to the abrasive jet. The addition of the pressurized gas to the abrasive jet can mildly disperse or diffuse the abrasive jet as generally described above with reference to FIG. 1D, while still supplying a constant flow rate of abrasives and fluid in the abrasive jet. In other embodiments, however, the flow rate of the abrasives and/or fluid can vary. The method 508 further includes determining when to conclude the piercing operation (decision block 508). If the piercing is to continue the method returns to block 506. When piercing concludes, however, the process 500 includes deactivating the pressurized gas flow to the cutting head (block 510), and determining if further cutting or other material removal is required (decision block 512). If further cutting is desired, the process 500 includes cutting the target material with the abrasive jet including abrasive and pressurized fluid and without the pressurized gas (block 514). Cutting with the pressurized gas removed from the abrasive jet produces a generally uniform abrasive jet as described above with reference to FIG. 1C. Moreover, although the pressurized gas is no longer supplied to the abrasive jet, the flow rate of the abrasives and the pressurized fluid can remain constant. In other embodiments, however, the flow rate of the abrasives and/or the pressurized fluid can vary after removing the pressurized gas from the abrasive jet. According to additional features of the illustrated embodiment, the abrasive jet system can begin cutting at the location of the hole that was initially pierced through the workpiece. Additionally or alternatively, the abrasive jet system can repeat the steps at blocks 506 and/or 514 one or more times to pierce and/or cut the workpiece one or more times (e.g., to make multiple holes or cuts in the workpiece). Those of ordinary skill in the art will understand that there are multiple suitable ways in which an abrasive jet system can vary sequences of piercing and cutting operations.

When the cutting concludes, the process 500 further includes deactivating the abrasive flow and the pressurized fluid flow to the cutting head (block 516). If further cutting is not desired following decision block 512, the process 500 can also proceed to block 516. In determining whether to conclude piercing (decision block 508) and/or cutting (decision block 512), the controller can receive an indication from a component that detects the completion of the piercing and/or cutting operations. In other embodiments, the controller can cause the piercing and/or cutting operations to conclude after a predetermined period of time that is based upon various factors such as the thickness of the workpiece, a dwell time, the pressure of the gas flowing through the cutting head, the abrasive flow rate, as well as other suitable factors.

After block 516, the process 500 can conclude. Those of ordinary skill in the art will appreciate that the steps shown in FIG. 5 may be altered in a variety of ways without departing from the spirit or scope of the present disclosure. For example, the order of the steps may be rearranged, sub-steps may be performed in parallel, illustrated steps may be omitted, additional steps may be included, etc.

From the foregoing, it will be appreciated that specific embodiments have been described herein for purposes of illustration, but that various modifications may be made without deviating from the spirit and scope of the disclosure. As an example of one modification to embodiments of the present disclosure, although the systems described herein include a pressurized gas source, the pressurized gas source can include other suitable sources of gases or fluids that are mixed with abrasives and delivered to a cutting head or delivered directly to the cutting head. As another example, the pressurized gas sources described herein can include two or more separate pressurized gas sources, each independently controllable by a controller. Moreover, each of the first and second pressurized gas supply conduits can be operably coupleable to corresponding separate pressurized gas sources. The first and second pressurized gas supply conduits can each include corresponding flow control valves that are independently controllable by a controller. The use of two or more separate and independent pressurized gas sources can enable the use of different gas pressures in the corresponding pressurized gas supply conduits. This can allow the pressurized gas sources to, among other things, provide a pressure in the abrasive container that is different from the pressure in the abrasive supply conduit.

As an example of another modification to embodiments of the present disclosure, although the controller can include a computer, the controller can include an integrated circuit, a microcontroller, an application-specific integrated circuit, or any device or apparatus suitable for controlling the abrasive jet system and/or the gas pressurization system. Moreover, while instructions for controlling the abrasive jet system and the pressurized gas sources as disclosed herein have been described as being implemented in software, such instructions can be implemented in software, hardware, firmware, or any combination thereof.

As a further example of modifications to embodiments of the disclosure, an abrasive jet system can include a first cutting head for cutting operations and a separate second cutting or piercing head for piercing operations. The abrasive jet system could also include a switch to switch delivery of high-pressure fluid between the two cutting heads. The pressurized gas source can also be operably coupled to each of the cutting and piercing heads. The distance between the cutting head (for cutting operations) and the piercing head (for piercing operations) would be known to the controller. The controller could cause piercing cutting head to pierce a hole in a workpiece. Upon completion of the piercing, the controller could cause the cutting head to move so that cutting head is positioned over the pierced hole. The controller could then cause the cutting head to begin a cutting operation starting from the pierced hole. The controller could cause either the abrasive jet system to perform piercing operations prior to performing cutting operations, or cause the abrasive jet system to intersperse cutting operations with piercing operations. One advantage to an abrasive jet system having separate cutting and piercing heads is that the pressurized gas source could remain activated while no piercing operations are being performed, thereby obviating a need to cycle the pressurized gas source on and off. Instead, the controller could close the abrasive valve to prevent abrasives from being conveyed to the cutting head.

In still further embodiments, the components of the abrasive jet systems described above can be positioned in relatively close proximity to one another. In one embodiment, for example, the components described above can be located within approximately 5 feet or less from one another. For instance, all of these components can be located on the same table or bridge upon which the cutting head is positioned. In other embodiments, however, these components can be positioned at locations that are spaced more than 5 feet apart from each other.

While advantages associated with certain embodiments have been described in the context of those embodiments, other embodiments may also exhibit such advantages, and not all embodiments need necessarily exhibit such advantages to fall within the scope of the present disclosure. Moreover, the embodiments described may exhibit advantages other than those described herein. The following claims provide additional embodiments of the disclosure.

We claim:

1. A method for using a jet to cut a workpiece, the method comprising:

providing pressurized liquid to a cutting head of an abrasive jet system;

passing the liquid through an orifice within the cutting head to form a jet having a density;

flowing abrasive to the cutting head;

incorporating the abrasive into the jet downstream from the orifice, wherein the jet accelerates the incorporated abrasive towards an outlet of the cutting head;

flowing pressurized gas to the cutting head;

incorporating the gas into the jet downstream from the orifice, wherein the jet accelerates the incorporated gas towards the outlet, and wherein incorporating the gas reduces the density of the jet;

impacting the jet against a workpiece to pierce the workpiece at a starting point for an intended cut in the workpiece, wherein impacting the jet against the workpiece includes impacting the jet against the workpiece while the jet includes the abrasive and while the density of the jet is reduced;

stopping or otherwise reducing the flow of the pressurized gas to the cutting head after piercing through the workpiece or after piercing the workpiece to a desired piercing depth less than a full thickness of the workpiece, and while continuing to pass the liquid through the orifice to maintain the jet, wherein the stopping or otherwise reducing the flow of the pressurized gas increases the density of the jet; and cutting the workpiece along the intended cut after stopping or otherwise reducing the flow of the pressurized gas to the cutting head and while continuing to pass the liquid through the orifice to maintain the jet.

2. The method of claim 1 wherein flowing the pressurized gas to the cutting head includes flowing the pressurized gas to the cutting head while the pressurized gas carries the abrasive to the cutting head.

3. The method of claim 2 wherein flowing the pressurized gas to the cutting head includes flowing the pressurized gas from a pressurized gas source to the cutting head via a conduit operably positioned between the pressurized gas source and the cutting head.

4. The method of claim 3 wherein:

the orifice is a first orifice; and the method further comprises— passing the abrasive from an abrasive container into the conduit via a second orifice operably positioned between the abrasive container and the conduit, and combining the abrasive with the pressurized gas within the conduit while the pressurized gas flows through the conduit toward the cutting head.

5. The method of claim 4 wherein:

flowing the pressurized gas to the cutting head includes opening a valve operably positioned between the pressurized gas source and the conduit; and stopping or otherwise reducing the flow of the pressurized gas includes closing the valve.

6. The method of claim 5, further comprising pressurizing the abrasive container.

7. The method of claim 6 wherein pressurizing the abrasive container includes pressurizing the abrasive container to cause a pressure upstream of the second orifice to be at least generally equal to a pressure downstream of the second orifice.

8. The method of claim 1 wherein flowing the abrasive to the cutting head includes flowing the abrasive to the cutting head downstream from the orifice while separately flowing the pressurized gas to the cutting head.

9. The method of claim 1 wherein:

impacting the jet against a workpiece includes impacting the jet against a workpiece at a fluid pressure of greater than 1000 PSI and less than 10,000 PSI; and cutting the workpiece along the intended cut includes cutting the workpiece at a fluid pressure greater than 10,000 PSI.

10. The method of claim 1 wherein flowing pressurized gas to the cutting head includes operating a valve to flow the pressurized gas into an abrasive container.

11. The method of claim 1 wherein flowing pressurized gas to the cutting head includes operating a valve to a) flow a first portion of the pressurized gas into an abrasive container, and b) flow a second portion of the pressurized gas to the cutting head, wherein the second portion of the pressurized gas does not pass through the abrasive container.

12. The method of claim 11 wherein the valve is a first valve, and wherein flowing pressurized gas to the cutting head includes operating the first valve to maintain a generally equivalent pressure across a second valve positioned at an outlet of the abrasive container.

13. The method of claim 1 wherein flowing the pressurized gas to the cutting head includes flowing the pressurized gas through an abrasive supply conduit, and wherein the method further comprises operating a valve to flow the abrasive into a flow of the pressurized gas.

14. The method of claim 13 wherein operating a valve to flow the abrasive into a flow of the pressurized gas includes operating the valve to flow the abrasive into a collector portion adjacent an abrasive container.

15. The method of claim 14 wherein stopping or otherwise reducing the flow of the pressurized gas to the cutting head does not reduce a rate of a flow of the abrasive.

16. The method of claim 1 wherein flowing pressurized gas to the cutting head includes operating a valve via a controller to equalize a pressure across an abrasive container.

17. The method of claim 1 wherein flowing pressurized gas to the cutting head includes flowing the pressurized gas through an abrasive container.

18. The method of claim 1 wherein flowing pressurized gas to the cutting head includes flowing the pressurized gas through a collector portion of an abrasive supply conduit, and wherein flowing abrasive to the cutting head includes flowing abrasive from an abrasive container into the collector portion.

19. The method of claim 1 wherein stopping or otherwise reducing the flow of the pressurized gas to the cutting head does not reduce a rate of a flow of the abrasive.

* * * * *

UNITED STATES PATENT AND TRADEMARK OFFICE

CERTIFICATE OF CORRECTION

PATENT NO. : 9,108,297 B2
APPLICATION NO. : 13/165009
DATED : August 18, 2015
INVENTOR(S) : Ernst H. Schubert et al.

It is certified that error appears in the above-identified patent and that said Letters Patent is hereby corrected as shown below:

Specification, after the Cross-Reference to Related Applications paragraph, in column 1, at line 12, insert the paragraph below:

--ACKNOWLEDGEMENT OF GOVERNMENT SUPPORT

This invention was made with government support under National Science Foundation Grant No. 1058278. The Government has certain rights in this invention.--

Signed and Sealed this
Twenty-ninth Day of March, 2016

Michelle K. Lee

Michelle K. Lee
*Director of the United States Patent and Trademark Office*